US005430238A

United States Patent [19]

Chen

[11] Patent Number: 5,430,238

[45] Date of Patent: Jul. 4, 1995

[54] MUSIC BOX

[76] Inventor: Joseph Chen, P.O. Box 82-144, Taipei, Taiwan

[21] Appl. No.: 302,491

[22] Filed: Sep. 8, 1994

[51] Int. Cl.[6] ..... G10F 1/06

[52] U.S. Cl. ..... 84/95.2; 446/298; D17/24

[58] Field of Search ..... 84/94.1, 94.2, 95.1, 84/95.2; 446/280, 281, 282, 298, 303, 236, 297; D17/24

[56] References Cited

U.S. PATENT DOCUMENTS

| | | | |
|---|---|---|---|
| 4,197,778 | 4/1980 | Komatsu et al. | 84/95.2 |
| 5,070,753 | 12/1991 | Hou | 84/95.2 |
| 5,088,373 | 2/1992 | Hou | 84/95.2 |
| 5,342,988 | 8/1994 | Hsu et al. | 84/95.1 |

*Primary Examiner*—Michael L. Gellner
*Assistant Examiner*—Patrick J. Stanzione
*Attorney, Agent, or Firm*—Alfred Lei

[57] ABSTRACT

A music box including a base, a seat having a casing, a spiral spring fitted within the casing, a control lever connected to the spiral spring, a drum having a first end and a second end, a gear fixedly mounted the first end of the drum, a gear train connected to the spiral spring and engaging the gear, a hitting member fixedly mounted on the seat and having a plurality of tines in contact with the drum, a frame having a first leg fixedly mounted on the hitting member and a second leg fixedly mounted on the seat, a second gear meshed with the gear, an axle extending downward and vertically through the frame to engage with the second gear, a rack having a hole at one end and a pair of prongs at another, a linking member arranged on the rack and fixedly connected with the top end of the axle at a center, a slide slidably fitted between the prongs of the rack, a crank connected with the slide at one end and with an outer portion of the linking member at another end, a shaft vertically mounted on the slide, and a doll connected with a top end of the shaft.

1 Claim, 3 Drawing Sheets

MUSIC BOX

BACKGROUND OF THE INVENTION

It has been found that the conventional music box is simply a box with a mechanical device that produces a tune when the box is opened. However, such a music box is monotonous and too complicated in structure thereby increasing the cost thereof.

Therefore, it is an object of the present invention to provide a music box which may obviate and mitigate the above-mentioned drawbacks.

SUMMARY OF THE INVENTION

This invention relates to an improved music box.

It is the primary object of the present invention to provide a music box which can cause a doll to move backwards and forwards.

It is another object of the present invention to provide a music box which is simple in construction.

It is still another object of the present invention to provide a music box which is compact in size.

It is still another object of the present invention to provide a music box which is economic to produce.

It is a further object of the present invention to provide a music box which is amusing and interesting.

The other objects and merits and a fuller understanding of the present invention will be obtained by those having ordinary skill in the art when the following detailed description is read in conjunction with the accompanying drawings wherein like numerals refer to like or similar part.

DETAILED DESCRIPTION OF THE PREFERRED EMBODIMENT

Figure 1:
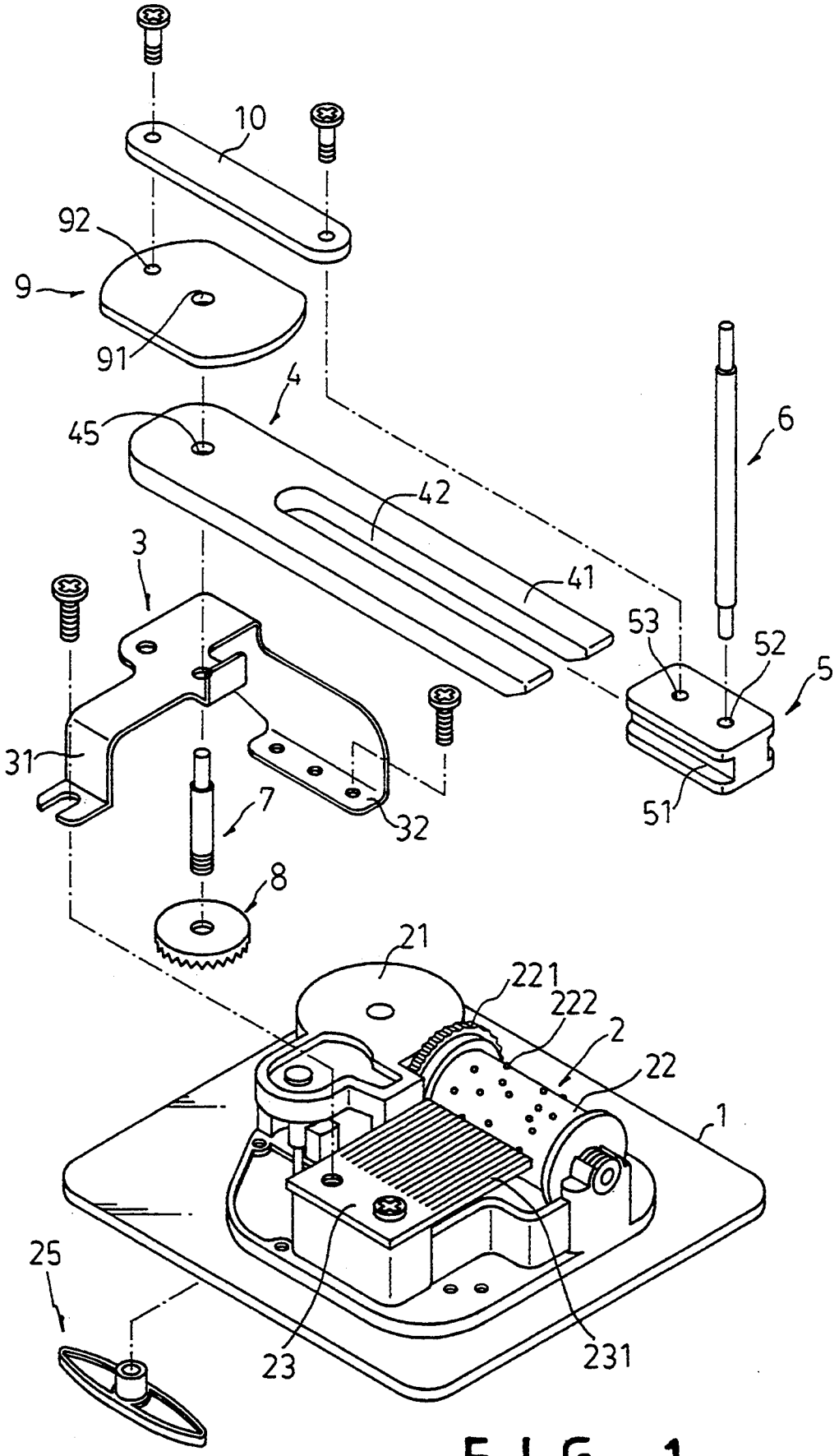
FIG. 1 is an exploded view of the present invention.

For the purpose of promoting an understanding of the principles of the invention, reference will now be made to embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Referring now to the drawings and in particular to FIG. 1 thereof, the music box according to the present invention mainly comprises a base 1, a seat 2, a frame 3, a rack 4, a slide 5, a shaft 6, an axle 7, a gear 8, a linking member 9, a crank 10, and a doll 20.

As illustrated, the seat 2 is fixedly mounted on the base 1 by screws (not shown). On the seat 2 is mounted a casing 21 in which is fitted a spiral spring (not shown). The spiral spring is connected with a control lever 25 by means of which the spiral spring can be turned tight. The spiral spring is connected with a gear train (not shown) so that the spiral spring will drive the gear train to rotate. The gear train is in turn engaged with a gear 221 which is fixedly mounted on one end of a drum 22 formed with a plurality of protuberances 222 thereon. A hitting member 23 having a plurality of tines 231 is fixedly mounted on the seat 2, with its tines 231 contacting the surface of the drum 22.

Figure 2:
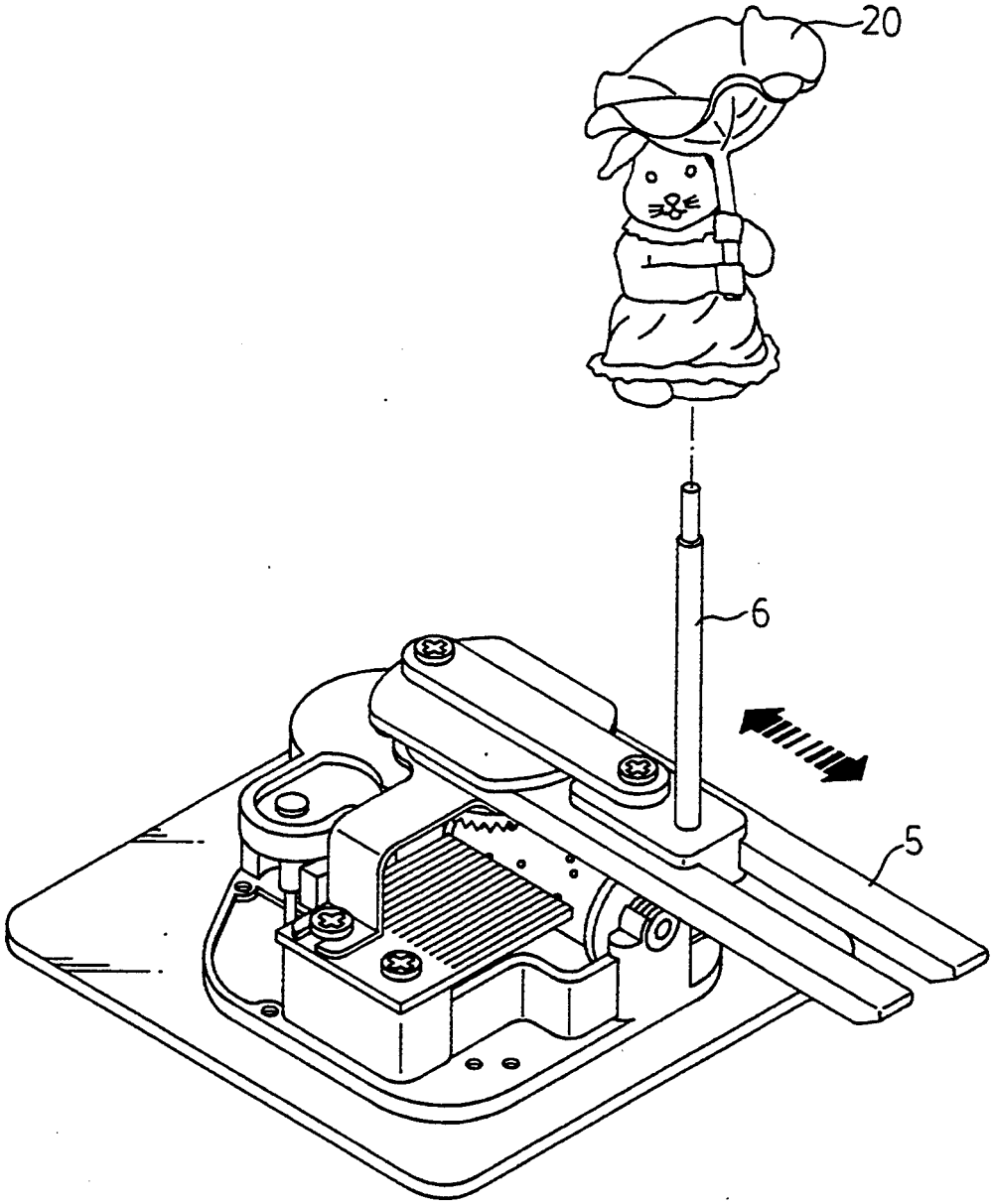
FIG. 2 is a perspective view of the present invention.
Figure 3:
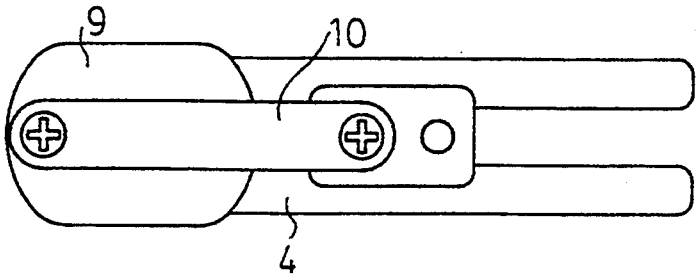
FIGS. 3, 4, 5 and 6 show the working principle of the present invention.
Figure 4:
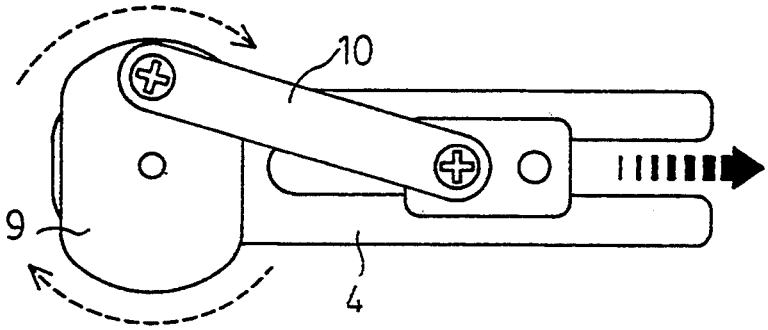
Figure 5:
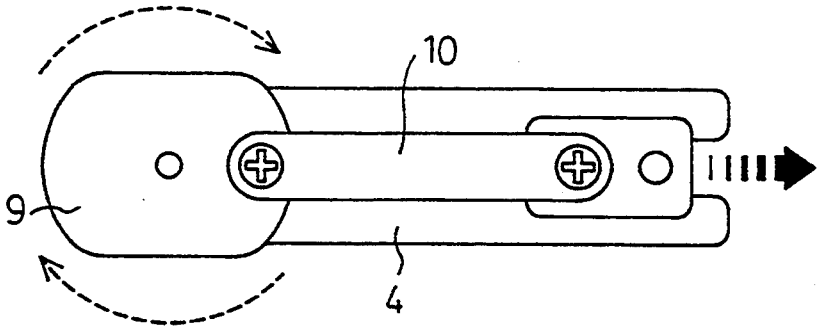
Figure 6:
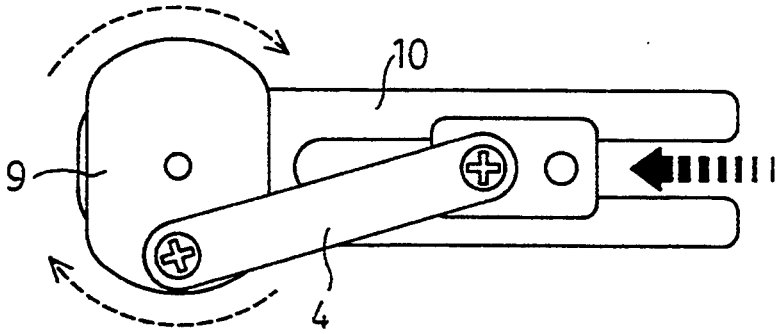

The frame 3 is provided with a first leg 31 fixedly mounted on the hitting member 23 and a second leg 32 fixedly mounted on the seat 2. The axle 7 extends downwardly and vertically through the frame 3 to engage with a gear 8 which is meshed with the gear 221 fixedly mounted on one end of the drum 22. The rack 4 has a hole 45 at one end and a pair of prongs 41 at another. Between the two prongs 41 there is a slot 42. The hole 45 receives the top end of the axle 7. The linking member 9 has a first aperture 91 at the center and a second aperture 92 at the outer portion and arranged on the rack 4 with the first aperture 91 fixedly connected to the top end of the shaft 7. The slide 5 is formed with a longitudinal groove 51 at both sides and first and second vertical holes 52 and 53 on the top. The slide 5 is slidably fitted between the two prongs 41 of the rack 4. The lower end of the shaft 6 is vertically inserted into the first vertical hole 52 of the slide 5. The crank 10 is pivotally connected with the aperture 92 of the linking member 9 at one end and with the second hole 53 of the slide 5 at another. The upper end of the shaft 6 is connected with a doll 20 (see FIG. 2).

With reference to FIGS. 3, 4, 5 and 6, there is shown the working principle of the present invention. When desired to produce music, simply turn the control lever 25 to turn the spiral spring tight and then release the control lever 25. Then, the spiral spring will drive the gear train which will in turn drive the gear 221 thereby rotating the drum 22. As the drum 22 is rotated, the tines 231 of the hitting member 23 will hit the protuberances 222 of the drum 22 hence producing music. In the meantime, the gear 221 will rotate the gear 8 which will in turn rotate the axle 7 thereby rotating the linking member 9. When the linking member 9 is turned, the crank 10 together with the slide 5 will be moved forwards and backwards. Hence, the doll 20 will be moved upward and downward by the slide 5.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A music box comprising:

a base;

a seat having a casing, said seat fixedly mounted on said base;

a spiral spring fitted within said casing;

a control lever connected to said spiral spring;

a drum having a first end and a second end, said drum including a pluraltiy of protuberances thereon;

a gear fixedly mounted the first end of said drum;

a gear train connected to said spiral spring and engaging said gear;

a hitting member fixedly mounted on said seat and having a plurality of tines in contact with said drum;

a frame having a first leg fixedly mounted on said hitting member and a second leg fixedly mounted on said seat;

a second gear meshed with said gear;

an axle extending downward and vertically through said frame to engage with said second gear;

a rack having a hole at one end and a pair of prongs at another, said hole receiving a top end of said axle;

a linking member arranged on said rack and fixedly connected with the top end of said axle at a center;

a slide slidably fitted between the prongs of said rack;

a crank connected with said slide at one end and with an outer portion of said linking member at another end;

a shaft vertically mounted on said slide; and a doll connected with a top end of said shaft.

* * * * *